US005337226A

United States Patent [19]

Wang et al.

[11] Patent Number: 5,337,226

[45] Date of Patent: Aug. 9, 1994

[54] PORTABLE TORCH WITH AN EXTENSIBLE LIGHT BULB ASSEMBLY

[76] Inventors: Jam-Min Wang, 6F, No. 350-21, Se. 1, Chi-Lung Rd., Hsin-I Dist., Taipei City; Cheng-Lan Shu, 5F, No. 18, Lane 66, Pai-Jen St., Hsin-Tien City, Taipei Hsien, both of Taiwan

[21] Appl. No.: 110,930

[22] Filed: Aug. 24, 1993

[51] Int. Cl.[5] ..... F21C 15/22

[52] U.S. Cl. ..... 362/198; 362/200

[58] Field of Search ..... 362/198, 190, 200, 208, 362/197

[56] References Cited

U.S. PATENT DOCUMENTS

| | | | |
|---|---|---|---|
| 1,692,394 | 11/1928 | Sundh | 362/198 |
| 1,755,472 | 4/1930 | Darungton | 362/198 |
| 2,550,423 | 9/1951 | Nelson | 367/198 |
| 4,870,543 | 9/1989 | Born et al. | 367/198 |
| 4,881,155 | 11/1989 | Gahagan | 362/200 |
| 4,931,913 | 6/1990 | Hwang | 362/103 |

*Primary Examiner*—Richard R. Cole

*Attorney, Agent, or Firm*—Sandler Greenblum & Bernstein

[57] ABSTRACT

The portable torch includes a light bulb assembly which can be drawn out from the main body to a desired place. The light bulb assembly has a clamping device for clamping the light bulb assembly adjacent to the desired place in order to provide better visibility.

5 Claims, 6 Drawing Sheets

PORTABLE TORCH WITH AN EXTENSIBLE LIGHT BULB ASSEMBLY

BACKGROUND OF THE INVENTION

1. Field of the Invention

The invention relates to a portable torch, more particularly to a portable torch that has a light bulb assembly which can be pulled out of a torch body to a desired location.

2. Description of the Related Art

FIG. 1 illustrates a conventional portable torch that includes a main body 2, a hand grip 4, a light bulb assembly 1 which is connected fixedly to the main body 2 and which is connected electrically to a battery unit inside the main body 2, and a power switch 5 to operate the conventional portable torch.

A main drawback of the conventional portable torch is that when repairing an automobile and the like, a mechanic must occasionally go under or reach into a narrow part of the automobile. Since the light bulb assembly of the conventional portable torch is inseparable from the main body, the conventional portable torch has to be held by another person and pointed toward a working spot in order to provide sufficient light thereat, thereby resulting in insufficient use of manpower and inconvenience to the user.

SUMMARY OF THE INVENTION

The main objective of the present invention is to provide a portable torch which has a light bulb assembly that is separable from the main body so that it can be pulled to a working spot in order to provide sufficient light thereat.

A second objective of the present invention is to provide a portable torch that includes a clamping device attached to the light bulb assembly so as to permit clamping of the light bulb assembly at the working spot.

A third objective of the present invention is to provide a portable torch which can be attached to the belt of the user.

According to the present invention, the portable torch includes a torch body with a first chamber that receives a battery unit, a second chamber that receives a rotatable reel, and a third chamber that receives a light bulb assembly therein. The third chamber is provided with an open end for removal and insertion the light bulb assembly. A cable has a first end connected electrically to the battery unit and a second end connected electrically to the light bulb assembly. The cable is wound around the rotatable reel. When the second end of the cable is pulled, the rotatable reel rotates in a first direction so that the light bulb assembly can be drawn out from the open end of the third chamber. The torch body further includes a biasing means for biasing the rotatable reel in a second direction to pull the light bulb assembly into the third chamber, and a retaining unit for retaining the rotatable reel at a desired position.

In one preferred embodiment, the light bulb assembly includes a first part, a second part and a clamping device. The first part has a first end which is provided with a threaded hole to receive a light bulb threadedly therein and a second end which is provided with a ball-shaped recess that includes an inner wall confining the ball-shaped recess. The clamping device includes a hollow tube, a pair of clamping units that are formed integrally with the hollow tube adjacent to one end thereof, and an elastic ball at another end of the same.

The elastic ball has a through hole communicated with the hollow tube. When the elastic ball is squeezed into the ball-shaped recess of the first part, it engages frictionally the inner wall confining the ball-shaped recess so that a desired position of the first part with respect to the hollow tube can be adjusted by turning the first part relative to the elastic ball.

Since the light bulb assembly is separable from the torch body, it can be pulled out of the torch body so as to be clamped adjacent to a working spot in order to provide sufficient light thereat. This facilitates repair of a lower portion of an automobile.

When not in use, the cable can be wound fully on the reel so as to be concealed within the second chamber by actuating the retaining unit. The light bulb assembly is correspondingly concealed in the third chamber at this stage.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
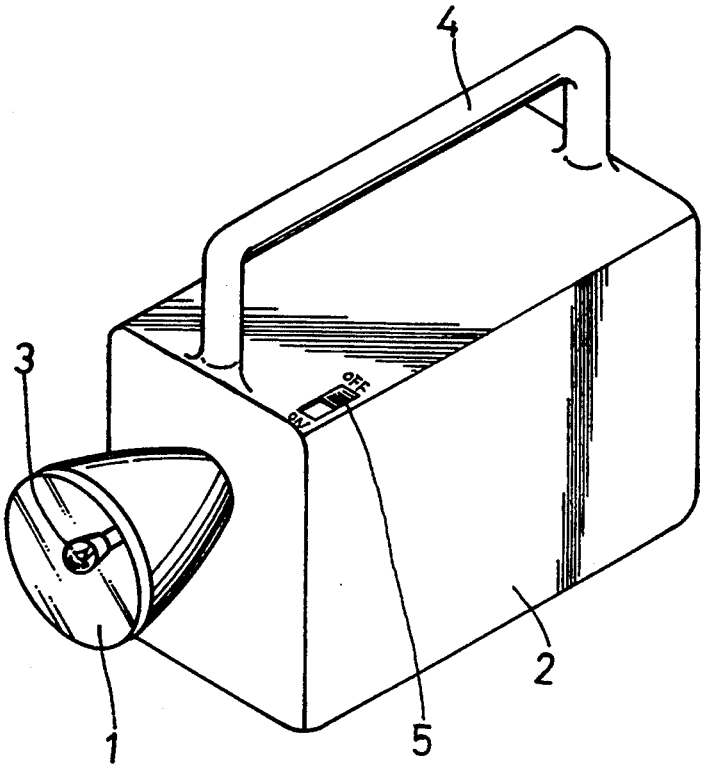
FIG.1 (PRIOR ART)
FIG. 1 illustrates a conventional portable torch.

Before the present invention is described in greater detail, it should be noted that like elements are indicated by the same reference numerals throughout the disclosure.

Figure 2:
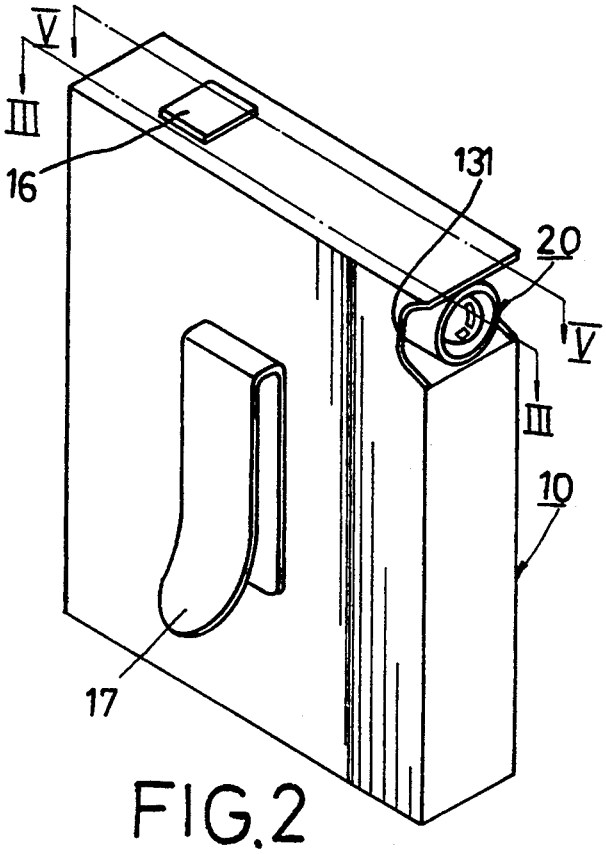
FIG. 2 illustrates a schematic, perspective view of a portable torch of the present invention.
Figure 3:
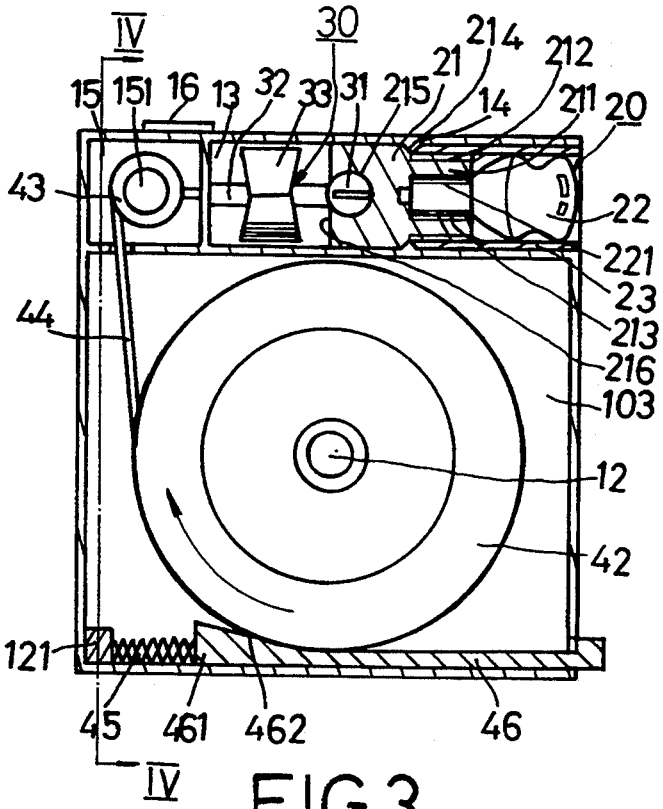
FIG. 3 is a cross sectional view of the portable torch of the present invention taken along the line III—III of FIG. 2.
Figure 4:
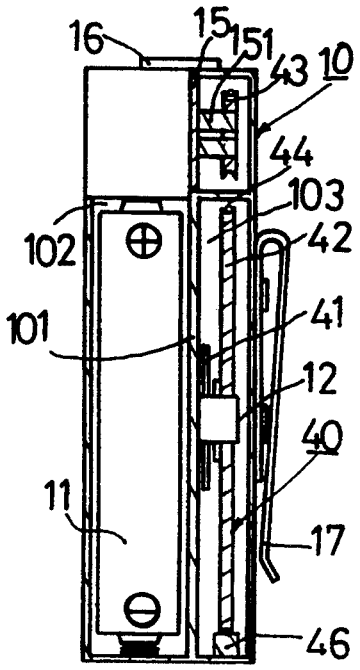
FIG. 4 is a cross sectional view of the portable torch of the present invention taken along the line IV—IV of FIG. 3.
Figure 5:
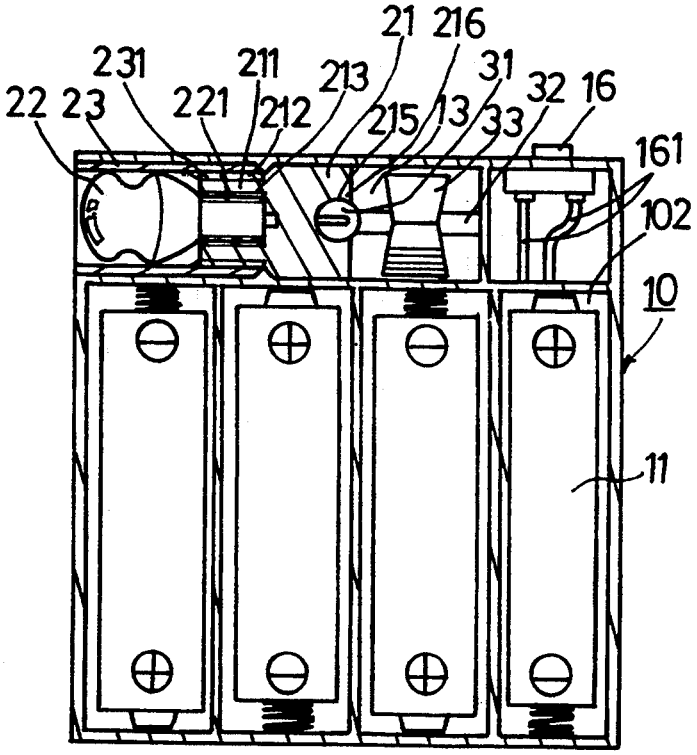
FIG. 5 is a cross sectional view of the portable torch of the present invention taken along the line V—V of FIG. 2.
Figure 6:
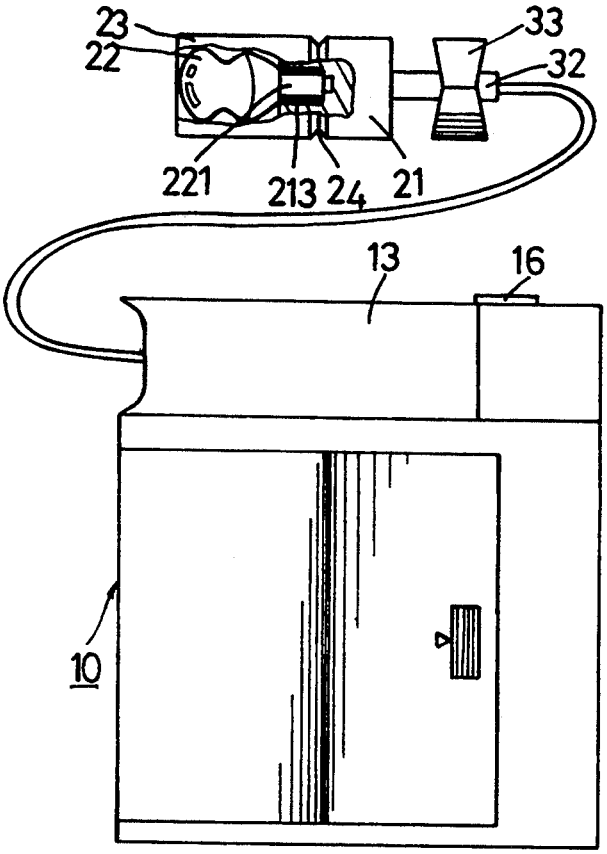
FIG. 6 illustrates the light bulb assembly in the portable torch of the present invention when pulled out of the main body.

Referring to FIGS. 2 to 4, a portable torch of the present invention includes a torch body 10 that has a lower portion with a first chamber 102, a second chamber 103, and a partition wall 101 which divides the first and second chambers 102, 103. A battery unit 11 is disposed inside the first chamber 102. The second chamber 103 has a stationary shaft 12 with a rotatable reel 42 mounted rotatably thereon. The torch body 10 has a clip 17 for securing the same on a person's waist belt.

A third chamber 13 is formed at an upper portion of the torch body 10. The third chamber 13 is provided with a mounting wall 15 that has a mounting shaft 151 on which a cable guide 43, which is in the form of a wheel, is mounted. The third chamber 13 is a wall body which confines a receiving channel therein and has an open end and two opposed notches 131 which are formed along the periphery of the open end, the purpose of which will be described in greater detail in the succeeding paragraphs. The third chamber 13 further has a resilient projection 14 which extends from an inner wall surface of the wall body.

Figure 7:
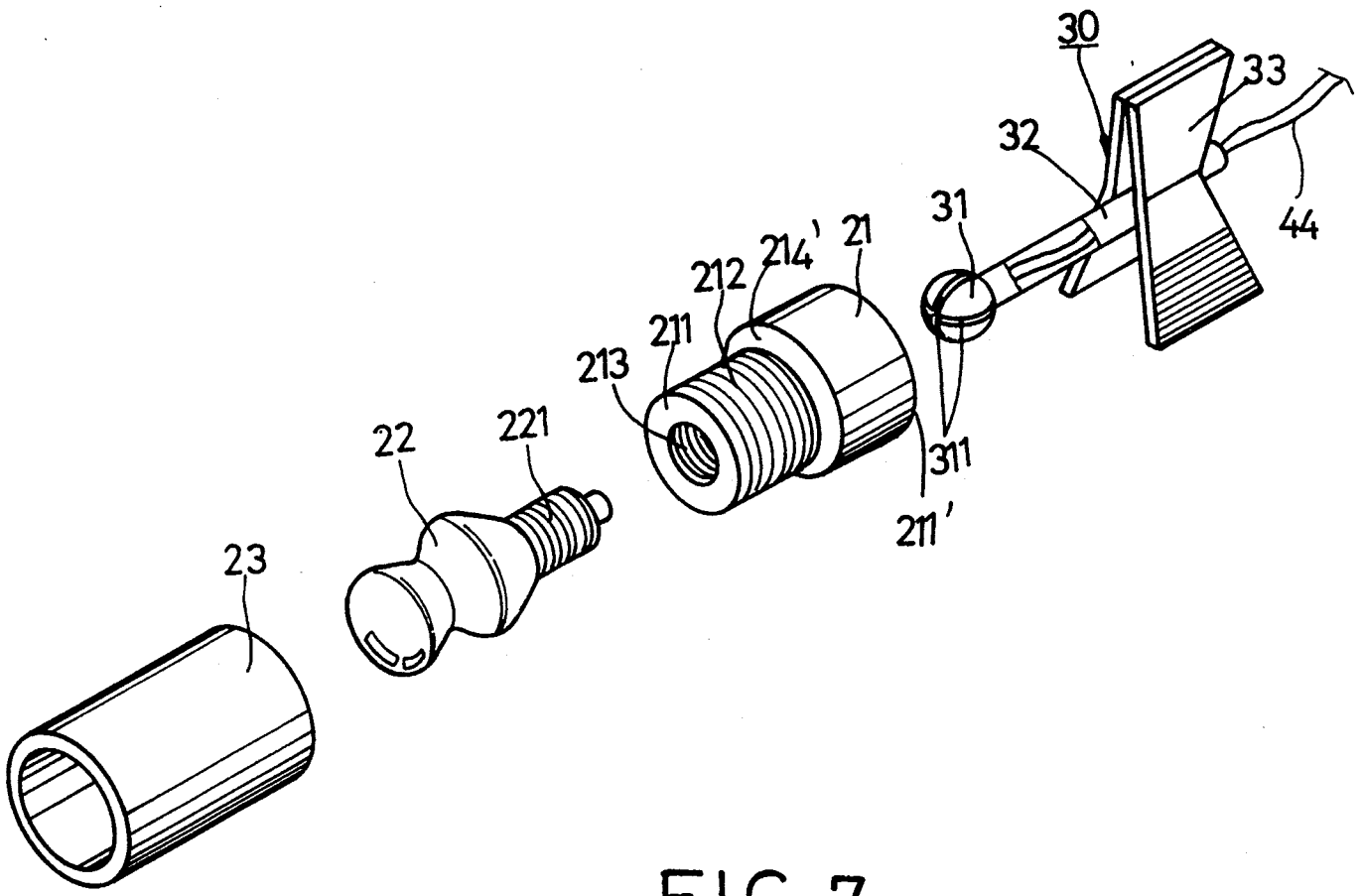
FIG. 7 illustrates an exploded view of the light bulb assembly and a clamping device which are employed in the portable torch of the present invention.
Figure 8:
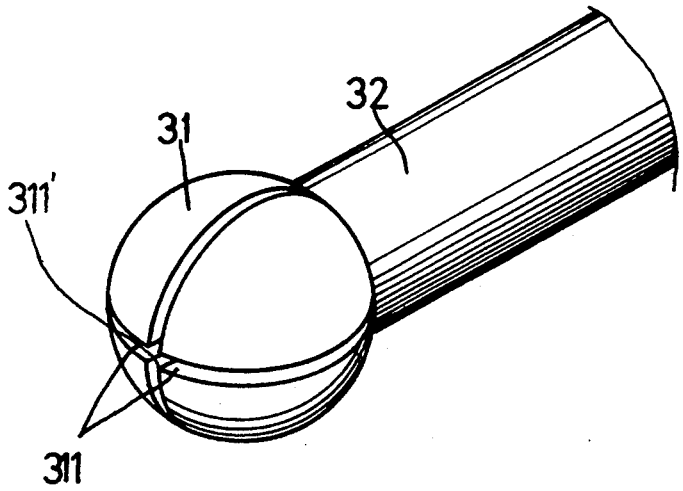
FIGS. 8 and 9 respectively show an enlarged view of the clamping device and how the clamping device is connected to the light bulb assembly in the portable torch of the present invention.
Figure 9:
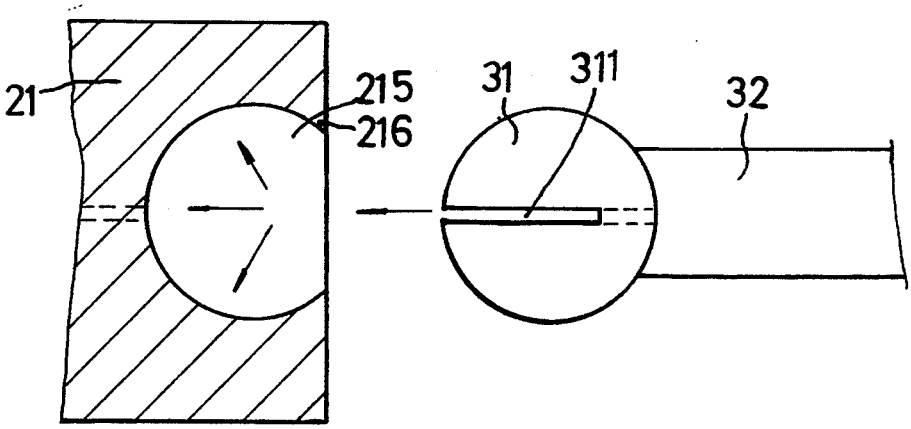

Referring to FIGS. 7 to 9, a light bulb assembly 20 includes first and second parts 21, 23 and a clamping device 30. The first part 21, which is in the shape of a cylinder, has a first end 211 that is provided with a threaded hole 213 to receive threadedly a light bulb 22 and a second end 211' that is provided with a ball-shaped recess 215 with an inner wall 216 that confines the ball-shaped recess 215. The ball-shaped recess 215 is communicated with the threaded hole 213.

The clamping device 30 includes a hollow tube 32, preferably made of plastic, a pair of clamping units 33 that are formed integrally with the hollow tube 32 adjacent to one end of the same, and an elastic ball 31 at another end of the hollow tube 32. Since the elastic ball 31 has a plurality of slits 311 and a through hole 311' that is communicated with the interior of the hollow tube 32, the elastic ball 31 can be squeezed into the ball-shaped recess 215, wherein an external surface of the elastic ball 31 engages frictionally the inner wall 216 of the first part 21 so that the first part 21 can be rotated relative to the elastic ball 31, thereby retaining the first part 21 at a desired position with respect to the hollow tube 3.

Each of the first and second parts 21, 23 has a circumferential shoulder 214' which is formed on an external surface. The shoulders 214' of the first and second parts 21, 23 cooperatively define a circumferential recess 214 of the light bulb assembly 20 when the first and second parts 21, 23 are threaded together. At such a condition, the second part 23 covers the light bulb 22. When the light bulb assembly 20 is disposed in the third chamber 13, a portion of the same is exposed from two opposed notches 131 of the third chamber 13. The resilient projection 14 extends into the circumferential recess 214 of the light bulb assembly 20, thereby preventing the latter from disengaging the torch body 10.

A cable 44 has a first end connected electrically to the battery unit 11 and a second end extending through the hollow tube 32 and the elastic ball 31 so as to connect electrically with the light bulb 22. The portion of the cable 44 that is between the battery unit 11 and the light bulb assembly 20 is guided by the cable guide 43 and then wound on the rotatable reel 42.

The torch body 10 has a power switch 16 which is connected electrically to the light bulb 22 and to the battery unit 11 via the cable 44 so that operation of the switch 16 can turn on or turn off the torch.

Note that a retaining means is disposed inside the second chamber 103. The retaining means includes a fixed seat 121 and a slide plate 461 mounted slidably on a bottom of the second chamber 103. A compression spring 45 is provided between the fixed seat 121 and the slide plate 461, thereby biasing the slide plate 461 to protrude out of the second chamber 103. At such a condition, a curved face 462 of the slide plate 461 abuts the periphery of the rotatable reel 42 to arrest rotation of the latter.

Figure 10:
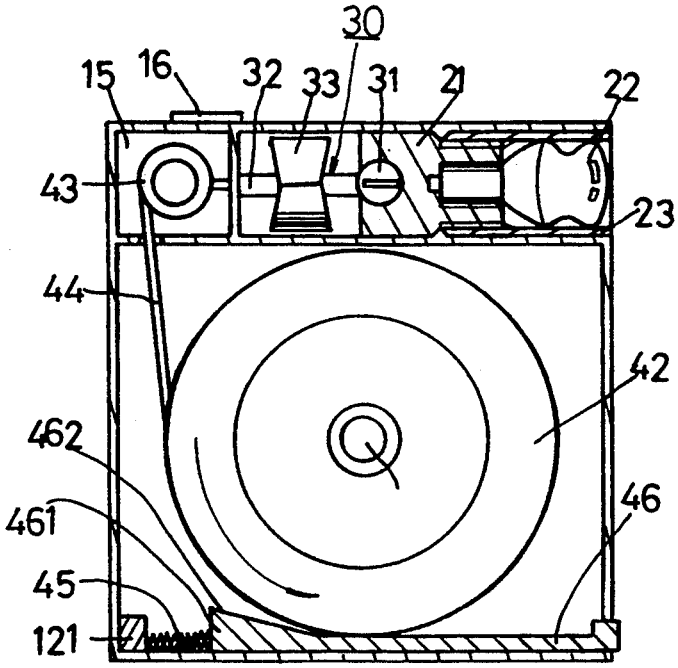
FIG. 10 is a cross sectional view of the portable torch of the present invention, illustrating rotation of the rotatable reel in order to wind a cable thereon.

In use, two fingers are inserted through the opposed notches 131 of the third chamber 13 to grasp the exposed portion of the light seat 20. The light bulb assembly 20 is pulled out of the third chamber 13. Since the pulling force is greater than the biasing action of the compression spring 45, the rotatable reel 42 rotates in a first direction against the biasing action of the compression spring 45. Thus, the light bulb assembly 20 can disposed to a desired working spot and can be clamped thereat with the use of the clamping device 30. The second chamber 103 has a biasing means, such as a torsional spring 41, that biases the rotatable reel 42 to rotate in a second direction opposite to the first direction, as shown in FIG. 10. The light bulb assembly 20 is pulled back toward the third chamber 13 by the torsional spring 41 once the pulling force is removed. Since the curved face 462 of the slide plate 461 abuts the rotatable reel 42, rotation of the rotatable reel 42 is arrested in order to locate the light bulb assembly 20 at the working spot when the pulling force is removed. During the working process, adjustment of the light bulb 22 relative to the clamping device 30 so as to provide better visibility can be achieved by turning the light bulb 22 with respect to the clamping device 30.

After use, the free end of the slide plate 461 is pushed so that the rotatable reel 42 can rotate in the second direction due to the torsional spring 41. The cable 44 is drawn into the third chamber 13 so as to be wound on the rotatable reel 42, thereby drawing the light bulb assembly adjacent to the open end of the third chamber 13. The light bulb assembly 20 is then pushed to conceal the same in the third chamber 13.

The portable torch of the present invention is compact and can be attached to the user's belt. Since the light bulb assembly 20 is separable from the torch body 10 and further includes a clamping device, the light bulb 22 can be clamped adjacent to a desired spot in order to provide sufficient lighting thereat.

While a preferred embodiment has been described and explained, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. A portable torch with an extensible light bulb assembly, comprising:

a torch body including a first chamber receiving a battery unit, a second chamber receiving a rotatable reel and a third chamber receiving a light bulb assembly, said third chamber having an open end to permit passage of said light bulb assembly;

a cable having a first end connected electrically to said battery unit and a second end connected electrically to said light bulb assembly, said cable being wound around said rotatable reel, said rotatable reel rotating in a first direction when said light bulb assembly is drawn out from said open end of said third chamber so as to extend said light bulb assembly to a desired location;

means for biasing said rotatable reel to rotate in a second direction to draw said light bulb assembly back into said third chamber; and means for retaining said rotatable reel at a desired position;

wherein said light bulb assembly includes a circumferential recess that is formed on an external surface thereof, said third chamber having an inner wall from which a resilient projection extends into said circumferential recess of said light bulb assembly so as to prevent said light bulb assembly form disengaging said third chamber, said third chamber further having two opposed notches that are formed along a periphery of said open end, a section of said light bulb assembly being exposed via said two opposed notches.

2. The portable torch as defined in claim 1, wherein said light bulb assembly includes first and second parts and a clamping device, said first part having a first end which is provided with a threaded hole to receive threadedly a light bulb therein and a second end opposite to said first end which is formed with a ball-shaped recess that has an inner wall confining said ball-shaped recess, said clamping device including a hollow tube, a pair of clamping units that are formed integrally with said hollow tube adjacent to one end thereof and an elastic ball formed at another end of said hollow tube, said elastic ball having a through hole communicated with said hollow tube and being squeezed into said ball-shaped recess of said first part, said elastic ball having an external surface that engages frictionally said inner wall of said ball-shaped recess, said first part being rotatable relative to said elastic ball so as to retain said first part at a desired position with respect to said hollow tube, said second part being hollow and being connected threadedly to said first part to cover said light bulb, each of said first and second parts having a circumferential shoulder which is formed thereon and which cooperatively define said circumferential recess when said first and second parts are threaded together.

3. The portable torch as defined in claim 1, wherein said torch body further includes a cable guide provided in the third chamber for guiding said cable.

4. The portable torch as defined in claim 1, wherein said torch body further includes a power switch for operating said light bulb assembly.

5. The portable torch as defined in claim 1, wherein said torch body further includes a clip for securing removably said portable torch on a waist-belt of a user.

* * * * *

UNITED STATES PATENT AND TRADEMARK OFFICE

CERTIFICATE OF CORRECTION

PATENT NO. : 5,337,226

DATED : August 9, 1994

INVENTOR(S) : Jam-Min WANG et al.

It is certified that error appears in the above-indentified patent and that said Letters Patent is hereby corrected as shown below:

At column 5, line 3 (claim 1, line 26), change "form" to ---from---.

Signed and Sealed this

Twenty-first Day of March, 1995

*Attest:*

Bruce Lehman

BRUCE LEHMAN

*Attesting Officer*

*Commissioner of Patents and Trademarks*